US005114137A

United States Patent [19]

Olson

[11] Patent Number: 5,114,137

[45] Date of Patent: May 19, 1992

[54] RIGHT ANGLE TURN TABLE AND METHOD

[76] Inventor: Ray E. Olson, 2200 NW. 32nd St., Ste. 200, Pompano Beach, Fla. 33069

[21] Appl. No.: 653,372

[22] Filed: Feb. 11, 1991

[51] Int. Cl.[5] ..... B65H 9/04

[52] U.S. Cl. ..... 271/251; 271/184

[58] Field of Search ..... 271/184, 185, 250, 251

[56] References Cited

U.S. PATENT DOCUMENTS

| | | | |
|---|---|---|---|
| 2,190,416 | 2/1940 | Davidson | 271/251 |
| 2,841,394 | 7/1958 | Stobb | 271/87 |
| 3,700,232 | 10/1972 | Wiegert et al. | 271/75 |
| 4,330,116 | 5/1982 | Newsome | 271/178 |
| 4,669,711 | 6/1987 | Beer | 267/140 |
| 4,669,719 | 6/1987 | Fratangelo | 271/185 X |
| 4,756,521 | 7/1988 | Martin | 271/225 |
| 4,889,333 | 12/1989 | Gammerler | 271/272 |

FOREIGN PATENT DOCUMENTS

| | | | |
|---|---|---|---|
| 90343 | 6/1982 | Japan | 271/251 |

*Primary Examiner*—Richard A. Schacher

*Attorney, Agent, or Firm*—Oltman and Flynn

[57] ABSTRACT

A device for rotating papers includes at least one conveyer belt for moving each paper through the device, at least one ball for rolling on top of each paper moving on the conveyer belt for holding the paper in position, retaining rails extending over the conveyer belt for rotatably retaining the ball, a fulcrum assembly positioned adjacent to the conveyer belt for stopping part of each paper while the belt pulls the paper radially around the fulcrum assembly, thereby rotating the paper. The fulcrum assembly preferably includes a fulcrum ball which rests against a paper support plate for wedging the paper when it makes contact with the fulcrum ball between the fulcrum ball and the support plate. A method for rotating papers includes the steps of placing the papers sequentially on at least one conveyer belt, holding the papers against the belt with at least one ball riding on top of the papers which is free to rotate but is retained against linear movement, blocking the path of part of each paper with a fulcrum and moving the remainder of the paper around the fulcrum with the belt so that the paper rotates around the fulcrum.

17 Claims, 3 Drawing Sheets

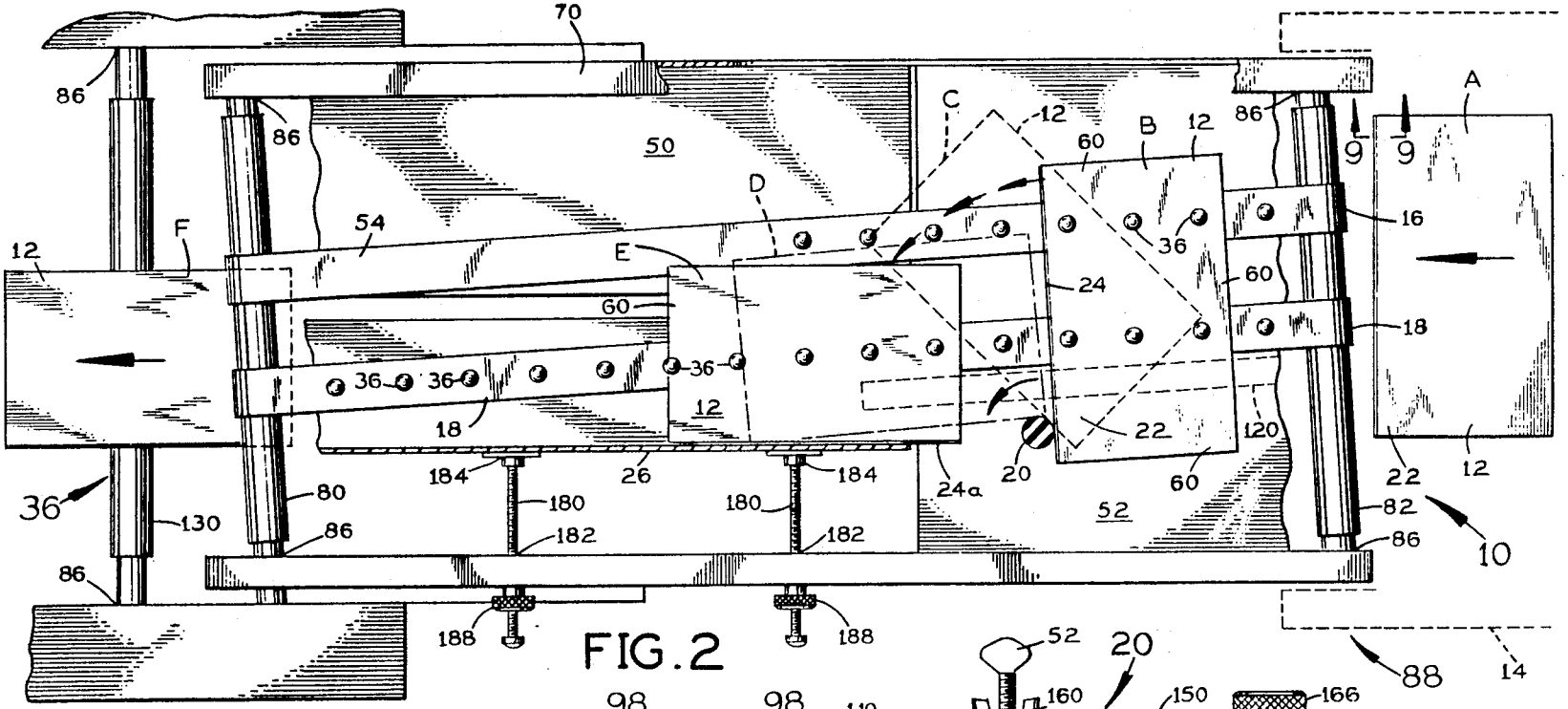
FIG. 2
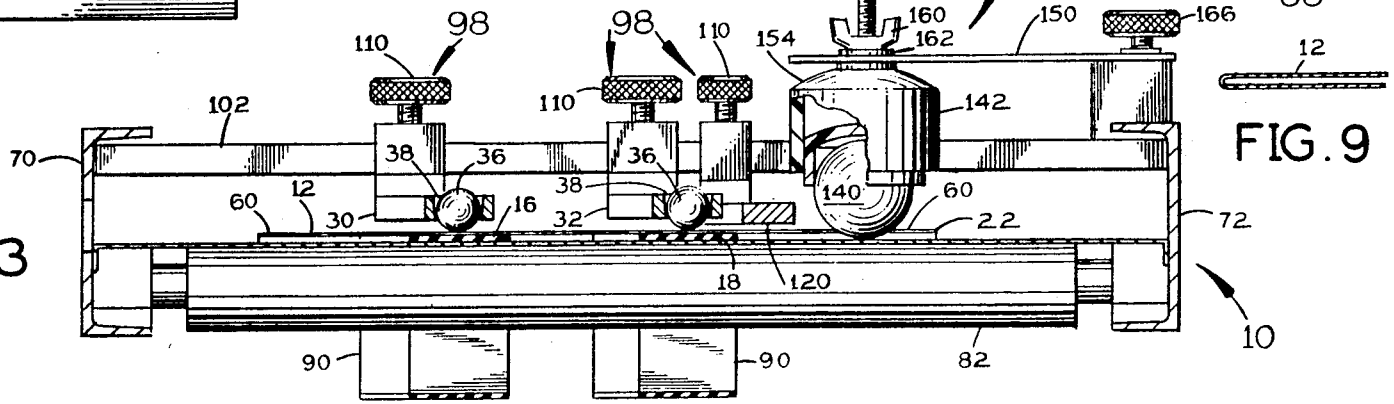
FIG. 3
FIG. 9

RIGHT ANGLE TURN TABLE AND METHOD

BACKGROUND OF THE INVENTION

1. Field of the Invention

The present invention relates generally to the field of guiding pieces of paper on a processing line, and more specifically to a high speed device for receiving pieces of paper in sequence from a folding machine, horizontally rotating them ninety degrees and sequentially dispensing the rotated pieces of paper.

2. Description of the Prior Art

A limited number of methods and devices have been developed for rotating pieces of paper moving along a paper processing line. Rotation of paper can be necessary between processing stages, for example after folding or printing and before packaging. The paper is sometimes just rotated manually by an employee. Yet paper must often move through the line at high speed and this step can become the slow point which limits the speed of the entire line. Even machinery which would grasp and turn each paper would necessarily be slower than other elements of most paper processing lines.

It is thus an object of the present invention to provide a paper rotating device and method which can accept, rotate and expel pieces of paper at a very high speed corresponding to that of other elements in a typical processing line.

It is another object of the present invention to provide a paper rotating device and method which is simple in construction, easy to use and easy to service.

It is finally an object of the present invention to provide a paper rotating device and method which is inexpensive and reliable.

SUMMARY OF THE INVENTION

The present invention accomplishes the above-stated objectives, as well as others, as may be determined by a fair reading and interpretation of the entire specification.

A device for rotating papers is disclosed which includes at least one conveyer belt for moving each paper through the device, at least one ball for rolling on top of each paper moving on the conveyer belt for holding the paper in position, retaining rails extending over the conveyer belt for rotatably retaining the ball, a fulcrum assembly positioned adjacent to the conveyer belt for stopping part of each paper while the belt pulls the paper radially around the fulcrum assembly, thereby rotating the paper. The retaining rails preferably have at least one hole for receiving and retaining the ball, which is of such a diameter that a portion of the ball extends through the hole and below the rails to make contact with and roll on top of the papers. The hole preferably has an upper edge and a lower edge and is beveled from one diameter at its upper edge to a smaller diameter at its lower edge, the smaller diameter at the lower edge being less than the diameter of the ball, for suspending the ball within the hole. The device has at least two mounting walls which are essentially parallel between which the elements of the device are contained or attached. Paper support plates surround the upper segment of the belt to support the portions of each paper extending beyond the conveyer belt. The fulcrum assembly preferably includes a fulcrum ball which rests against one of the paper support plates for wedging the paper when it makes contact with the fulcrum ball between the fulcrum ball and the support plate. The fulcrum assembly also includes a socket which fits over the top of the fulcrum ball.

A method for rotating papers is also disclosed which includes the steps of placing the papers sequentially on at least one conveyer belt, holding the papers against the belt with at least one ball riding on top of the papers which is free to rotate but is retained against linear movement, blocking the path of part of each paper with a fulcrum and moving the remainder of the paper around the fulcrum with the belt so that the paper rotates around the fulcrum. The method may additionally include the step of stopping the rotation of the paper with a guide.

BRIEF DESCRIPTION OF THE DRAWINGS

Various other objects, advantages, and features of the invention will become apparent to those skilled in the art from the following discussion taken in conjunction with the following drawings, in which:

FIG. 2 is a sectional top view of the preferred embodiment of the device illustrating the advance of a paper through the rotation process. The letter "A" identifies a paper entering the inventive device, "B" identifies the paper on the conveyer belts as it reaches the fulcrum assembly, "C" identifies the paper, shown in broken lines, beginning rotation around the fulcrum assembly, "D" identifies the paper at the end of rotation making contact with the lateral guide, "E" identifies the paper oriented along the guide, and "F" identifies the rotated paper exiting the inventive device on the third axle.

FIG. 3 is a sectional side view from the dispensing end showing in detail the fulcrum assembly in relation to the rail carriages, belts and paper.

FIG. 9 is a sectional edge view of a folded paper from the folding machine.

DETAILED DESCRIPTION OF THE PREFERRED EMBODIMENTS

Figures 1, 6:
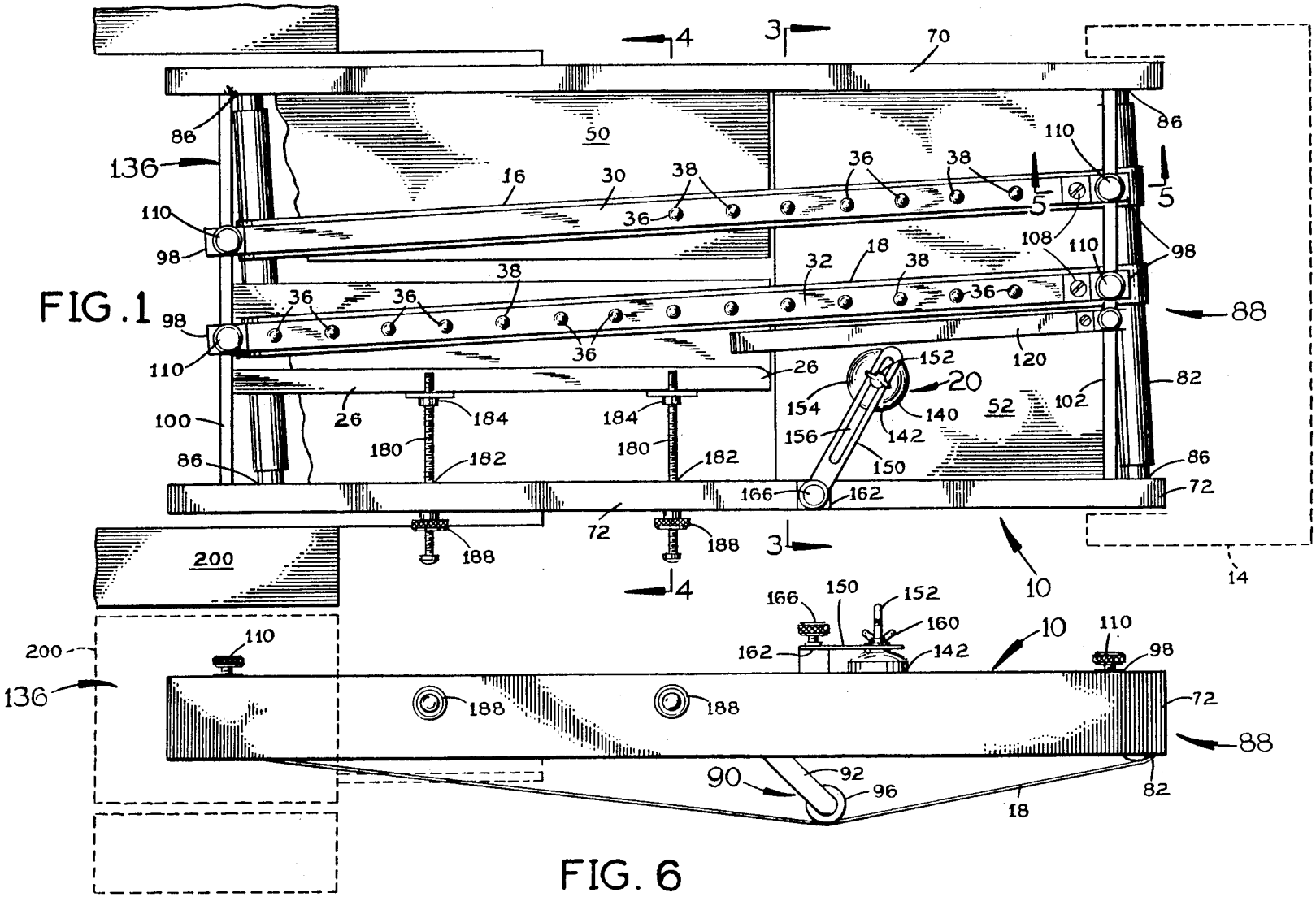
FIG. 1 is a sectional top view of the preferred embodiment of the inventive device illustrating the retaining rails, balls and fulcrum assembly.
FIG. 6 is a side view of the inventive device illustrating the long, rectangular shape of a mounting wall, the upper elements and position of the fulcrum assembly, and a belt tensioning assembly.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiment

Referring to FIG. 1, a device 10 for receiving pieces of paper, hereinafter papers 12, from a paper folding machine 14 and rotating them within an essentially horizontal plane is disclosed. Device 10 has two parallel conveyer belts 16 and 18 for moving each paper 12 and a fulcrum assembly 20 for rotating paper 12. Assembly 20 blocks the path of one corner 22 of paper 12 while belts 16 and 18 pull the remainder of paper 12 radially around assembly 20. See FIG. 2. Leading edge 24 of paper 12 rotates 90 degrees and becomes a side edge 24*a*. Edge 24*a* comes into contact with a lateral guide 26 which stops the rotation, orients and guides paper 12 in the desired direction.

Figures 4, 5, 7, 8:
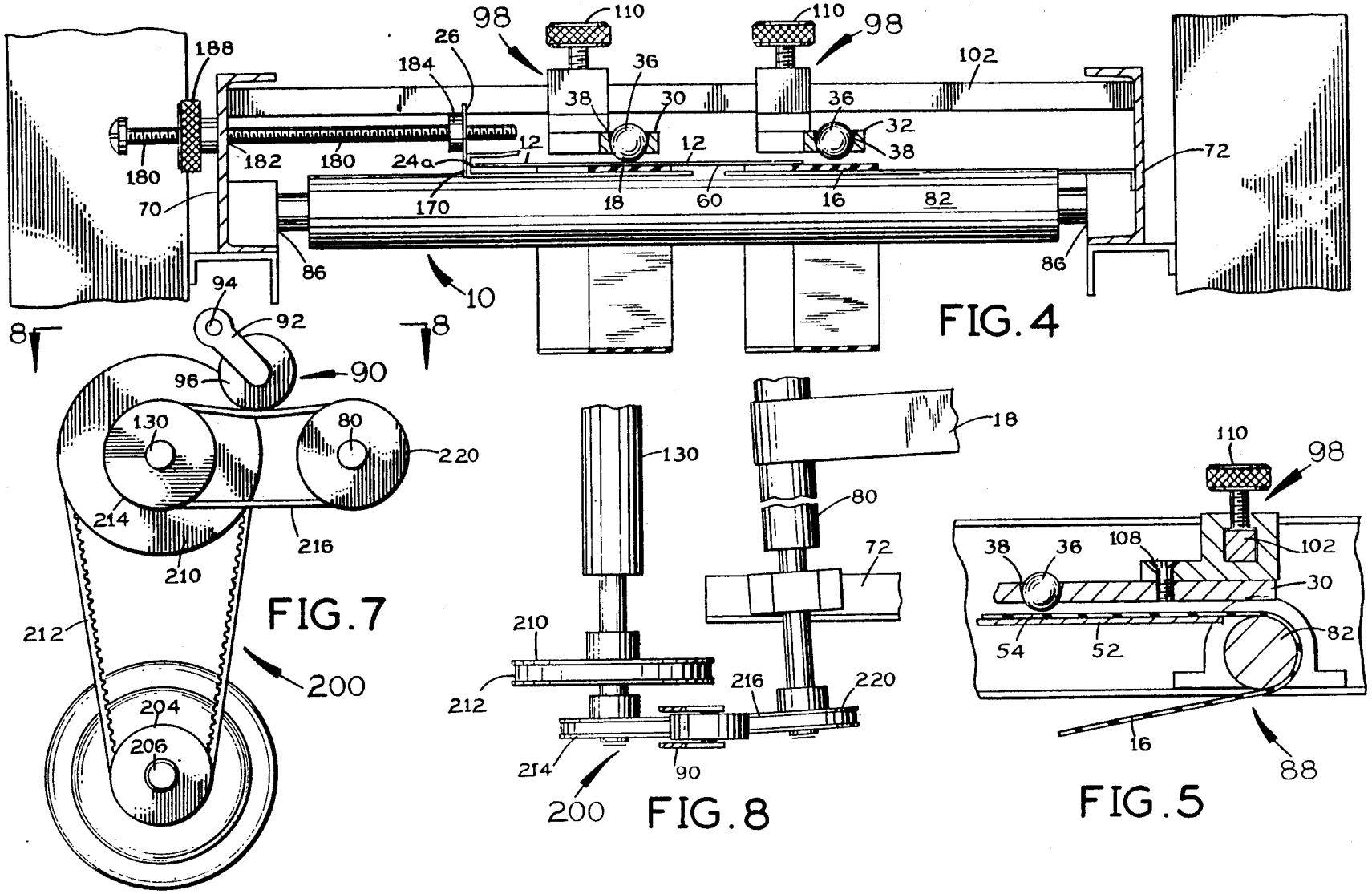
FIG. 4 is a sectional end view from the dispensing end showing the guide, guide channel, guide adjustment screw and nut in relation to the rail carriages, belts and paper.
FIG. 5 is a close-up sectional side view of a rail carriage, rail and belt showing the positions of the rail fastening screw and set screw, and the square cross-section of the shaft and the carriage bore.
FIG. 7 is a side view of the motor assembly showing the motor and the several pulleys and belts for transmitting power to the conveyer belt axles, and a belt tensioning assembly.
FIG. 8 is a top view of the motor assembly showing portions of the two axles nearest the dispensing end, the upper pulleys and belts, and a belt tensioning assembly.

Belts 16 and 18 preferably have low-friction surfaces so that each paper 12 can slide with minimal resistance during rotation. Two retaining rails 30 and 32 are positioned directly over and parallel to belts 16 and 18, respectively. A series of balls 36 are retained in a corresponding series of holes 38 in each of rails 30 and 32 and ride on papers 12 passing under them. See FIGS. 3, 4 and 5. Holes 38 are preferably beveled inside to a diameter at their lower edge slightly smaller than that of balls 36. This permits balls 36 to be retained and suspended within holes 38 without falling through. Balls 36 rotate freely in holes 38 and their weight holds papers 12 against belts 16 and 18. An advantage of balls 36 over, for example, cylindrical rollers is their ability to continually change rolling direction to follow paper 12.

Support plates 50 and 52 extend through belts 16 and 18 just below their upper loop segments 54 and 56. Plates 50 and 52 support the portions 60 of papers 12 extending over the edges of belts 16 and 18.

Device 10 elements are mounted between walls 70 and 72 which are parallel, elongated rectangles. Belts 16 and 18 ride on parallel axles 80 and 82 which extend between the remote ends of walls 70 and 72. Holes 86 are provided in walls 70 and 72, and preferably fitted with bearings, to receive axles 80 and 82 and permit them to rotate freely.

Fulcrum assembly 20 is positioned adjacent to belts 16 and 18 near the paper 12 receiving end 88 of device 10. Axles 80 and 82 are both preferably angled about five degrees away from perpendicularity with walls 70 and 72 while remaining in a horizontal plane. This angling orients papers 12 in the direction of desired rotation help initiate the rotation. Tensioning assemblies 90 press against belts 16 and 18. See FIG. 6. Each tensioning assembly 90 preferably includes a spring-biased arm 92 with a pivot pin 94 at one end and a pulley wheel 96 at the other end. Pulley wheel 96 bears against the associated belt 16 or 18.

The positions of rails 30 and 32 are horizontally adjustable. Rails 30 and 32 have carriages 98 which ride on shafts 100 and 102 extending between and perpendicular to walls 70 and 72. Shafts 100 and 102 pass through bores 104 in carriages 98. Rails 30 and 32 are fastened to shafts 100 and 102 with screws 108. Carriages 98 are fitted with set screws 110 which secure rails 30 and 32 to shafts 100 and 102 when desired rail positioning is achieved. Shafts 100 and 102 and bores 104 are preferably square in cross-section to prevent carriages 98 from rotating with respect to shafts 100 and 102. See FIG. 5.

A third rail 120 joined to a carriage 98 is preferably provided on shaft 102. See FIGS. 1 and 3. Rail 120 is located between assembly 20 and rail 32 and extends about half way to shaft 100. Rail 120 presses lightly against paper 12 near assembly 20 to position each corner 22 for contact with assembly 20.

A third axle 130 is mounted perpendicularly between walls 70 and 72, and between axle 80 and the dispensing end 136 of device 10. See FIG. 2. Axle 130 is located in the same horizontal plane and has the same diameter as axles 80 and 82. After papers 12 are carried over axle 80, they are picked up by axle 130. Axle 130, unlike axles 80 and 82, is perpendicular to guide 26 and thus carries papers 12 in the desired exit direction.

Assembly 20 preferably includes a fulcrum ball 140 formed of a high-friction material which rests on top of plate 52. See FIG. 3. A socket 142 fits snugly over the upper half of ball 140 and is connected to wall 72 by a bracket 150. A threaded stem, preferably a thumb screw 152, extends vertically out of the top 154 of socket 142 and through an axial slot 156 in bracket 150. A wing nut 160 is provided on thumb screw 152 above bracket 150. Ball 140 and socket 142 can slide to a desired position along slot 156 and be locked into place by tightening wing nut 160 against bracket 150. Bracket 150 extends over wall 72. A vertical set screw 166 passes through a hole 162 in bracket 150 and into wall 72. Set screw 166 can be loosened to permit pivoting bracket 150 to position ball 140 and then tightened to lock bracket 150 in place.

Ball 140 of assembly 20 makes point contact with plate 52 while rail 120 holds corner 22 against plate 52. When a paper 12 reaches assembly 20, corner 22 becomes wedged between ball 140 and plate 52. The high-friction composition of ball 140 enhances wedge gripping while paper 12 rotation occurs. As a result of paper 12 rotation, corner 22 is re-positioned so that it no longer must pass under ball 140 to advance with belts 16 and 18. Corner 22 is thus freed from its wedged position and proceeds along guide 26 toward paper dispensing end 136.

Guide 26 preferably has a channel 170 through which edges 24*a* of papers 12 slide. The lower side of channel 170 preferably provides a broad surface to support portions 60 of papers 12. See FIG. 4. Guide 26 can be adjusted toward or away from belts 16 and 18. Adjustment screws 180 pass perpendicularly through bores 182 in wall 72 and into sockets 184 on guide 26. Bores 182 are threaded to engage screws 180 so that rotating screws 180 in one direction advances guide 26 toward belts 16 and 18 and in the other direction draws guide 26 away. The angle of guide 26 with respect to belts 16 and 18 can be adjusted by rotating screws 180 different distances or directions relative to each other. To lock guide 26 into position, nuts 188 are provided around screws 180. Each screw 180 is manually held against rotation while its nut 188 is screwed tightly against wall 72. This action jams nut 188 threads against screw 180 threads and a face of nut 188 against wall 72 to block rotation.

Device 10 is driven by a motor and pulley assembly 200. See FIGS. 7 and 8. Motor 202 has a pulley 204 on its drive shaft 206. Pulley 204 is connected to a larger pulley 210 by a heavy-duty belt 212. Larger pulley 210 is mounted on axle 130. The larger diameter of pulley 210 reduces rotational speed between motor 202 and axle 130. A second small pulley 214 is mounted on axle 130 adjacent to pulley 210 and is connected to a third small pulley 220 with a belt 216. A tensioning assembly 90 as described above presses against belt 216. Pulley 220 has the same diameter as pulley 214 and is mounted on axle 80. Axle 80 thus rotates at the same speed as axle 130 and permits uniform movement of papers 12. Belts 16 and 18 connect axles 80 and 82, as set forth above, thus driving axle 82 at the same rotational speed as axle 80.

FIG. 9 illustrates in cross-section a paper 12 folded once at its middle by folding machine 14. Device 10 is particularly suited to receiving papers 12 from a folding machine 14, yet it is to be understood that device 10 can receive papers 12 from other types of paper processing line elements as well.

Method

In practicing the invention, the following method may be used. Papers 12 are sequentially fed from a paper folding machine 14 or other processing line element onto parallel belts 16 and 18. Papers 12 are held against belts 16 and 18 by freely rotatable balls 36 retained over belts 16 and 18. A fulcrum assembly 20 blocks the path of a corner 22 of each paper 12. Belts 16 and 18 pull the remainder of each paper 12 around fulcrum assembly 20 so that each paper 12 rotates a desired number of degrees, typically 90 degrees. Paper 12 rotation is stopped by a guide 26 which receives or abuts an edge of each paper 12. Each paper 12 is then carried to the next stage of processing.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A device for rotating papers comprising:

conveyer belt means for moving each paper through the device, wherein the conveyer belt means has at least one upper belt segment upon which the papers move, and wherein portions of each paper extend beyond the conveyer belt means, paper support means which surround the at least one upper belt segment to support the portions of each paper extending beyond the conveyer belt means, at least one ball for rolling on top of each paper moving on the conveyer belt means for holding the paper in position, retaining means extending over the conveyer belt means for rotatably retaining the at least one ball, fulcrum means positioned adjacent to the conveyer belt means for stopping part of each paper while the belt means pulls the paper radially around the fulcrum means, thereby rotating the paper, wherein the fulcrum means comprises a fulcrum ball which rests against the support means for wedging said part of each paper when it makes contact with the fulcrum ball between the fulcrum ball and the support means and bracket means connected to the fulcrum ball for securing the fulcrum ball in the desired location relative to the conveyor belt means and for securing the fulcrum ball against rotation.

2. A device as in claim 1 wherein the retaining means for retaining the at least on ball comprise at least one rail having at least one hole for receiving and retaining the at least one ball, the at least one hole being of such a diameter that a portion of the at least one ball extends through the at least one hole and below the at least one rail to make contact with and roll on top of the papers.

3. A device as in claim 2 wherein the at least one hole has an upper edge and a lower edge and is beveled from one diameter at its upper edge to a smaller diameter at its lower edge, the smaller diameter at the lower edge being less than the diameter of the at least one ball, for suspending the at least one ball within the at least one hole.

4. A device as in claim 2 additionally comprising:

a carriage at either end of the at least one rail having a bore extending through it, which passes through the bore of each carriage upon which the carriage and rails can slide for adjustment, set screw means in each carriage for securing each carriage to the shaft passing through its bore after adjustment.

5. A device as in claim 4 additionally comprising:

at least two mounting walls which are essentially parallel between which each shaft extends and to which each shaft is attached.

6. A device as in claim 1 wherein the paper support means comprise at least one horizontal plate.

7. A device as in claim 1 additionally comprising paper compressing rail means fixed above the support means adjacent to the fulcrum means for compressing the portion of the paper which will touch the fulcrum means between the compressing rail means and the support means to help the paper wedge between the fulcrum ball and the support means.

8. A device as in claim 1 wherein the fulcrum ball is formed of a high-friction material.

9. A device as in claim 1 additionally comprising guide means for directing each paper after it is rotated.

10. A device as in claim 9 wherein the guide means comprise a channel which receives an edge of the paper.

11. A device as in claim 9 wherein the guide means comprise a plate which abuts an edge of the paper.

12. A device as in claim 9 wherein the belt means are angled relative to the guide means in the direction of paper rotation to help initiate rotation.

13. A device as in claim 9, wherein the guide means comprises:

a channel through which an edge of each paper slides, said channel having screw sockets, adjustment screws, each passing through a threaded bore in a stationary member, and into one of the screw sockets, such that the adjustment screw threads mesh with the threads of the bore in the stationary member, for rotating and thereby adjusting the distance between the channel and the conveyor belt means and for changing the angle of the channel with respect to the conveyor belt means.

14. A device as in claim 1, wherein the bracket means comprises an arm pivotally connected to at least one mounting wall.

15. A device as in claim 1, wherein the bracket means comprises:

an arm having an axial slot, a connecting member attached to the fulcrum ball, a threaded stem with a nut on it which extends through the axial slot between the nut and the connecting member, so that the position of the connecting member on the arm can be adjusted by sliding the stem within the axial slot and the socket means can be secured following adjustment by tightening the nut against the arm.

16. A device as in claim 15, wherein the connecting member is a socket in the form of an inverted cup for securing over the top of the fulcrum ball.

17. A device for rotating papers comprising:

conveyer belt means for moving each paper through the device, wherein the conveyer belt means has at least one upper belt segment upon which the papers move, and wherein portions of each paper extend beyond the conveyer belt means, at least one ball for rolling on top of each paper moving on the conveyer belt means for holding the paper in position, retaining means extending over the conveyer belt means for rotatably retaining the at least one ball, fulcrum means positioned adjacent to the conveyer belt means for stopping part of each paper while the belt means pulls the paper radially around the fulcrum means, thereby rotating the paper, wherein the fulcrum means comprises a fulcrum ball which rests against the support means for wedging the paper when it makes contact with the fulcrum ball between the fulcrum ball and the support means, socket means which fits over the top of the fulcrum ball, bracket means for supporting the socket means, wherein the bracket means is an arm pivotally connected to at least one mounting wall, having an axial slot, and the socket means is an inverted cup having a threaded stem with a nut on it and the stem extends through the axial slot between the nut and the socket means, so that the position of the socket means on the bracket can be adjusted by sliding the stem within the axial slot and the socket means can be secured following adjustment by tightening the nut against the bracket means, paper support means which surround the at least one upper belt segment to support the portions of each paper extending beyond the conveyer belt means.

* * * * *